US005513691A

United States Patent [19]

Langner et al.

[11] Patent Number: 5,513,691

[45] Date of Patent: May 7, 1996

[54] MOLD FOR CONTINUOUS CASTING AND METHOD OF MAKING THE MOLD

[75] Inventors: Carl Langner, Monsey, N.Y.; Donald P. Lorento, Exeter, Canada

[73] Assignee: SMS Concast Inc., Montvale, N.J.

[21] Appl. No.: 190,296

[22] Filed: Feb. 2, 1994

[51] Int. Cl.[6] ..... B22D 11/04; B23K 31/02

[52] U.S. Cl. ..... 164/418; 29/402.13; 29/402.16; 228/174

[58] Field of Search ..... 164/418, 459; 228/174; 29/402.11, 402.13, 402.16

[56] References Cited

U.S. PATENT DOCUMENTS

| | | | |
|---|---|---|---|
| 3,295,172 | 1/1967 | Dain | 164/418 |

FOREIGN PATENT DOCUMENTS

| | | | |
|---|---|---|---|
| 0011537 | 5/1980 | European Pat. Off. . | |
| 0052947 | 6/1982 | European Pat. Off. . | |
| 2112384 | 6/1972 | France . | |
| 2459093 | 1/1981 | France . | |
| 3604273 | 8/1987 | Germany | 164/418 |
| 57-50251 | 3/1982 | Japan | 164/418 |
| 58-3754 | 1/1983 | Japan | 164/459 |
| 60-18252 | 1/1985 | Japan | 164/418 |
| 60-137555 | 7/1985 | Japan | 164/418 |
| 61-206548 | 9/1986 | Japan | 164/418 |
| 61-209753 | 9/1986 | Japan | 164/418 |
| 2-70358 | 3/1990 | Japan | 164/418 |
| 3-99754 | 4/1991 | Japan | 164/418 |
| 7406535 | 12/1974 | Netherlands . | |

OTHER PUBLICATIONS

Patent Abstracts of Japan, vol. 010 No. 388 (M–549), 25 Dec. 1986 of JPP 61–176444 published Aug. 8, 1986.

Patent Abstracts of Japan, vol. 006 No. 086 (M–131), 25 May 1982 of JPP 57–22852 published Feb. 5, 1982.

*Primary Examiner*—J. Reed Batten, Jr.

*Attorney, Agent, or Firm*—Darby & Darby

[57] ABSTRACT

A wall of a mold assembly for the continuous casting of steel has a steel back-up plate. A thermally conductive plate composed of copper or a copper alloy is bolted to the back-up plate and a relatively thin copper or copper alloy facing is soldered to that surface of the thermally conductive plate which faces away from the back-up plate. The thermally conductive plate may be omitted and the facing soldered to the back-up plate. The facing contacts and cools a continuously cast strand travelling through the mold. When the facing becomes cracked or worn beyond repair, the solder joint is melted to remove the facing and a fresh facing is soldered to the thermally conductive plate or back-up plate.

30 Claims, 6 Drawing Sheets

MOLD FOR CONTINUOUS CASTING AND METHOD OF MAKING THE MOLD

FIELD OF THE INVENTION

The invention relates to a continuous casting mold.

BACKGROUND OF THE INVENTION

Plate molds for the continuous casting of steel slabs consist of four separate walls which are held together by bolts and springs. Each wall consists of a steel back-up plate and a copper-containing plate which is mounted on the steel plate by means of bolts.

The copper-containing plate, which serves to contact and cool a continuously cast slab or strand, is expensive. There are two primary reasons for this. On the one hand, the grade of copper or copper alloy used for the copper-containing plate is costly. On the other hand, the copper-containing plate is machined before being mounted on the back-up plate in order to provide the copper-containing plate with cooling channels.

The copper-containing plate undergoes wear during use and must be machined periodically to remove surface irregularities. However, the number of times that the copper-containing plate can be machined is limited and the copper-containing plate must then be discarded. This increases operating costs.

Similar problems exist in mold assemblies for the continuous casting of beam blanks.

Furthermore, in certain applications, the copper-containing plate tends to develop cracks within a relatively short period of time. Once cracking has occurred, the copper-containing plate can no longer be used and must again be discarded.

SUMMARY OF THE INVENTION

It is an object of the invention to provide a mold wall which permits operating expenses to be reduced.

Another object of the invention is to provide a mold wall which can be refurbished relatively inexpensively even if the cooling surface develops cracks.

An additional object of the invention is to provide a method which allows the operating expenses for a mold assembly to be reduced.

A further object of the invention is to provide a method which makes it possible to repair a mold wall relatively inexpensively even when cracking of the cooling surface occurs.

The preceding objects, as well as others which will become apparent as the description proceeds, are achieved by the invention.

One aspect of the invention resides in a wall for a continuous casting mold, particularly a mold for the continuous casting of steel. The wall comprises a carrier, a thermally conductive facing on the carrier adapted to contact and cool a continuously cast strand travelling through the mold, and a fusible connecting layer joining the facing to the carrier. The connecting layer, which preferably comprises a solder, has a melting point lower than that of the carrier and the facing.

Another aspect of the invention resides in a method of making a mold, particularly a mold for the continuous casting of steel. The method comprises the step of sandwiching a fusible material between a carrier element and a thermally conductive facing for the carrier element. The fusible material has a melting point lower than those of the carrier element and the facing, and the method further comprises the step of joining the facing to the carrier element. The joining step includes melting the fusible material to thereby form a connecting layer between the carrier element and the facing upon solidification of the molten material. It is preferred for the fusible material to comprise a solder.

The method may additionally comprise the steps of removing the facing from the carrier element by melting the fusible material, sandwiching fresh fusible material between the carrier element and a fresh facing for the carrier element, and melting the fresh material to thereby form a fresh connecting layer between the carrier element and the fresh facing upon solidification of the molten fresh material.

The method may also comprise the step of inserting a fastening element into the carrier element via a surface of the carrier element which confronts the facing. The inserting step is then performed prior to the sandwiching step.

BRIEF DESCRIPTION OF THE DRAWINGS

Other features and advantages of the invention will become apparent from the following description of certain presently preferred embodiments when read in conjunction with the accompanying drawings.

Figure 1:
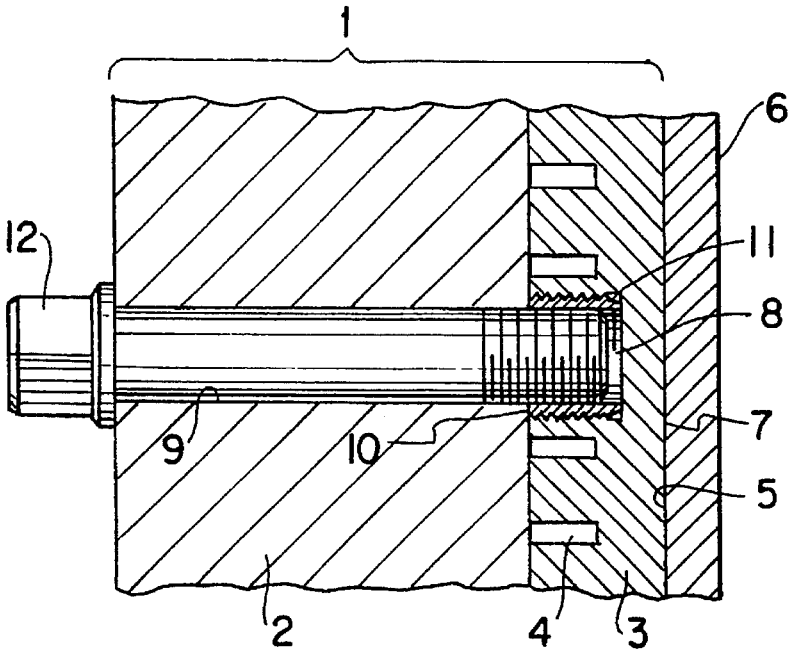
FIG. 1 is a fragmentary, transverse horizontal sectional view of one embodiment of a mold wall according to the invention.
Figure 2:
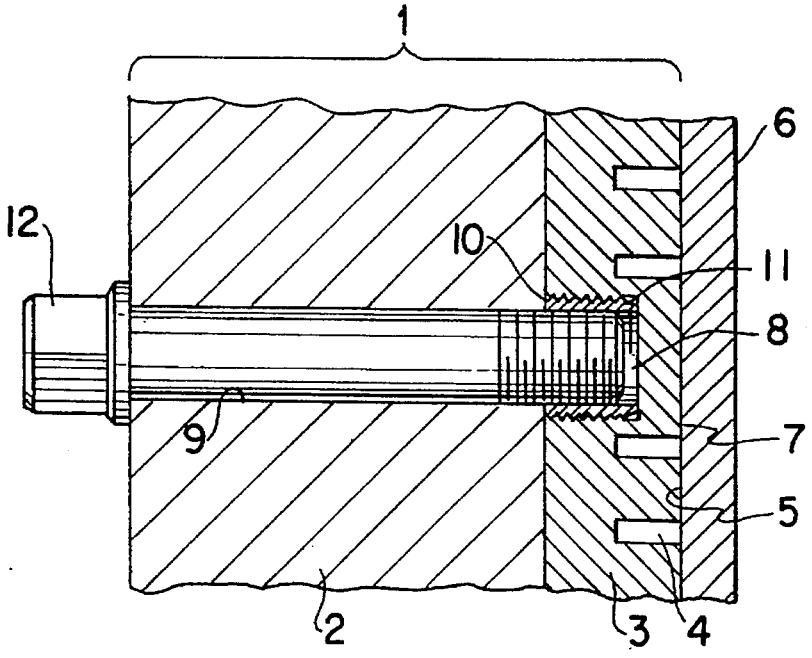
FIG. 2 is a view similar to that of FIG. 1 of another embodiment of a mold wall in accordance with the invention.
Figure 3:
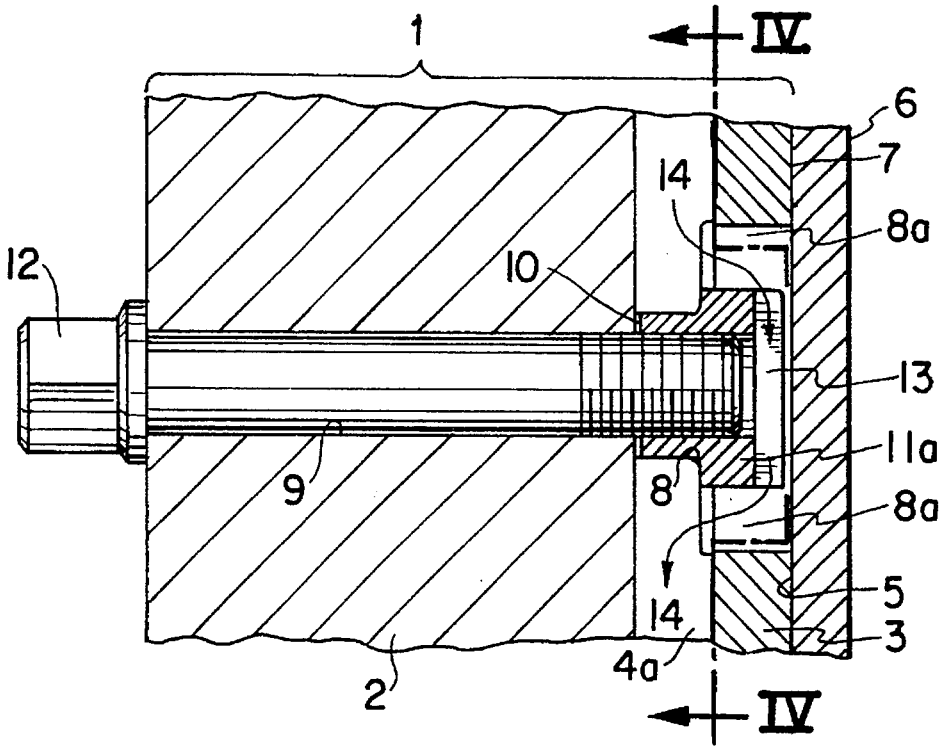
FIG. 3 is a fragmentary, transverse vertical sectional view of an additional embodiment of a mold wall per the invention.
Figure 5:
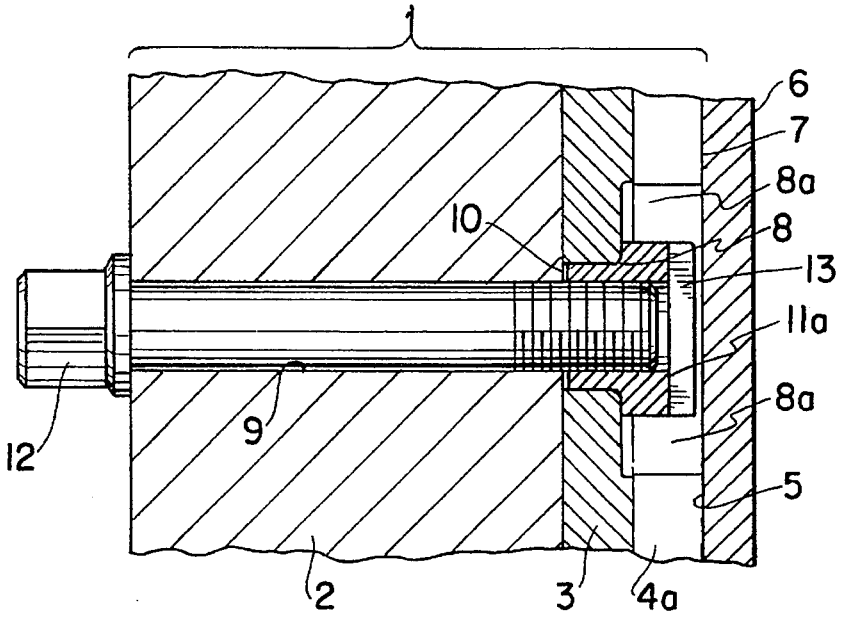
FIG. 5 is a view similar to that of FIG. 3 of a further embodiment of a mold wall according to the invention.
Figure 8:
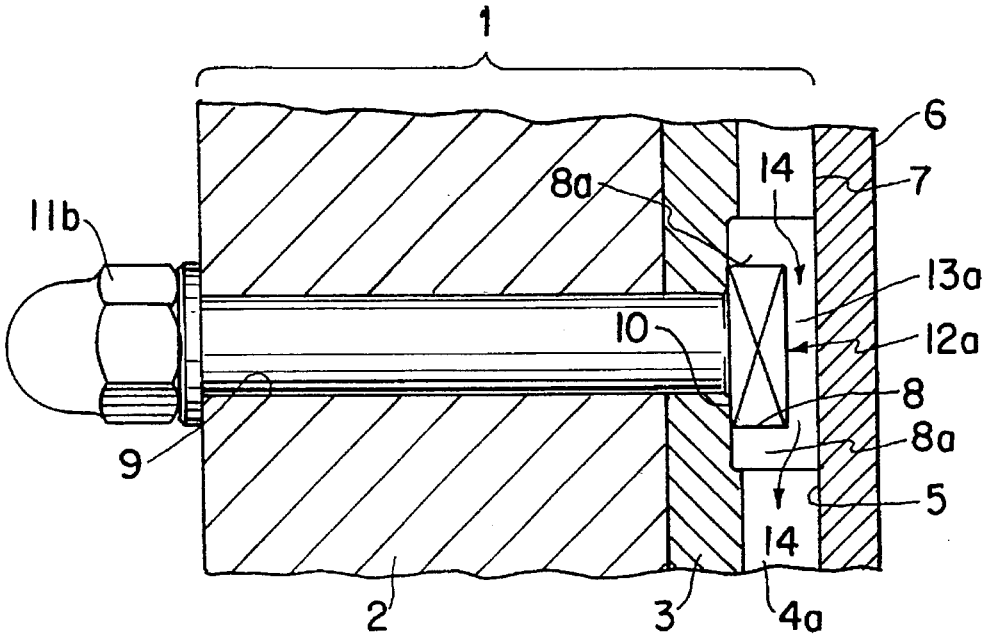
FIG. 8 is a view similar to that of FIG. 3 of still another embodiment of a mold wall per the invention.
Figure 13:
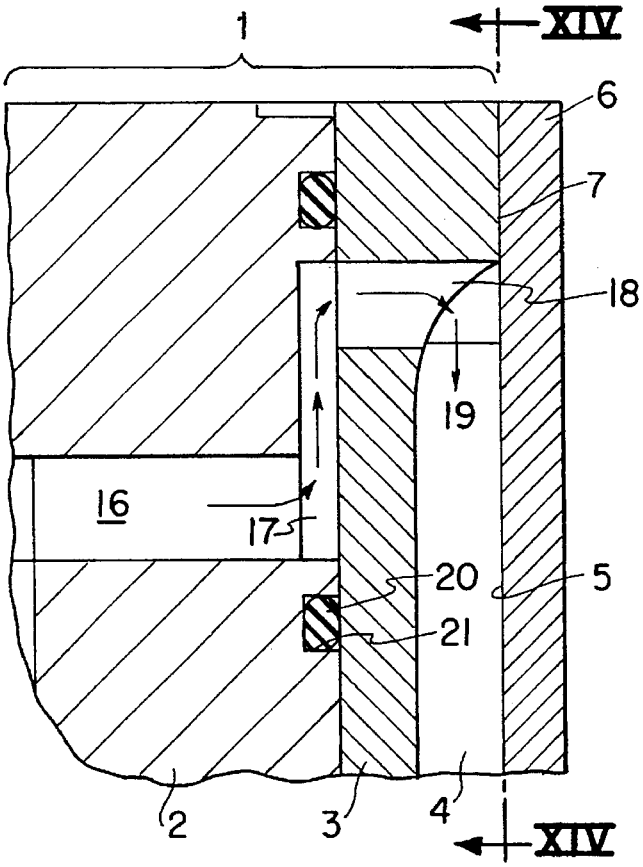
Figure 14:
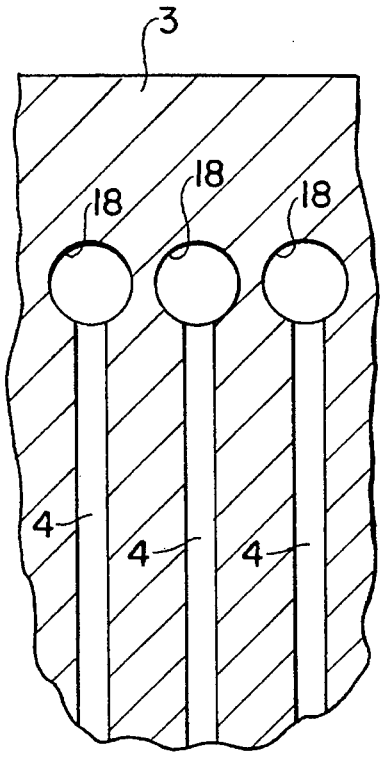

FIG, 12 is a view similar to that of FIG. 1 of yet another embodiment of a mold wall according to the invention;

FIG. 13 is a view similar to that of FIG. 3 illustrating a detail of the mold walls of FIGS. 2, 5 and 8; and FIG. 14 is a sectional view as seen in the direction of the arrows XIV—XIV of FIG. 13,

DESCRIPTION OF PREFERRED EMBODIMENTS

FIG. 1 illustrates one wall of a plate mold for use in continuous casting, e.g., the continuous casting of steel. In operation, the mold wall of FIG. 1 is assembled with additional, similar walls to form a mold having an open-ended casting passage. For example, the mold wall of FIG. 1 can be combined with three other mold walls to define a casting passage of rectangular cross section. Molten material is continuously admitted into one end of the casting passage and a solidified or partially solidified casting or strand is continuously withdrawn from the other end of the casting passage.

The mold wall of FIG. 1 includes a carrier 1 made up of a back-up plate or carrier element 2 and a plate or carrier element 3 having high thermal conductivity. By way of example, the back-up plate 2 may be composed of steel while the thermally conductive plate 3 may be composed of copper or a copper alloy. Any copper or copper alloy employed in continuous casting molds can be used for the thermally conductive plate 3. As shown, the thermally conductive plate 3 can be provided with cooling channels 4. The cooling channels 4 are here located adjacent the back-up plate 2 and open to the latter.

The thermally conductive plate 3 has a major surface 5 which faces away from the back-up plate 2. A facing 6 in the form of a sheet or plate is provided on the surface 5 and has high thermal conductivity. The facing 6 is adapted to contact and cool a continuously cast strand and may, for instance, be composed of copper or a copper alloy. The material of the facing 6 can be the same as or different from that used for the thermally conductive plate 3.

The facing 6 is connected to the thermally conductive plate 3 by means of a layer 7 of fusible material. The layer 7 preferably consists of solder but any other suitable material could also be used for the layer 7. The material of the layer 7 should be capable of establishing a firm bond between the facing 6 and the thermally conductive plate 3 and should have relatively high thermal conductivity.

The carrier 1 is provided with a plurality of bolting holes of which only one is shown. Each bolting hole has a circular portion 8 of larger cross section in the thermally conductive plate 3 and a circular portion 9 of smaller cross section which traverses the back-up plate 2. The larger portion 8 and smaller portion 9 of a bolting hole 8,9 cooperate to define a shoulder at the interface between the back-up plate 2 and the thermally conductive plate 3. The larger portion 8 of a bolting hole 8,9 is threaded and a hollow, externally threaded insert 11 is screwed into such larger portion 8 and is confined by the respective shoulder 10. The insert 11 is provided with an internal thread, and the internal thread meshes with the externally threaded end of a bolt 12 which extends through the back-up plate 2 into the thermally conductive plate 3. The bolt 12 functions to hold the back-up plate 2 and thermally conductive plate 3 together.

To make the mold wall of FIG. 1, a sheet or layer of fusible material is sandwiched between the conductive plate surface 5 and the thermally conductive facing 6. The fusible material is then melted. Upon solidification of the fusible material to form the layer 7, the facing 6 is bonded to the thermally conductive plate 3. The faced thermally conductive plate 3 is now assembled with the back-up plate 2 to form the carrier 1. To this end, the inserts 11 are screwed into the larger hole portions 8. The back-up plate 2 and faced thermally conductive plate 3 are placed adjacent one another in such a manner that each smaller hole portion 9 is in register with a larger hole portion 8. The bolts 12 are then inserted in the bolting holes 8,9 and threaded into the inserts 11 to draw the back-up plate 2 and the faced thermally conductive plate 3 into firm engagement with one another.

It is evident that the facing 6 can be applied to the thermally conductive plate 3 after the back-up plate 2 and thermally conductive plate 3 have been bolted to each other.

When the facing 6 becomes cracked or has been worn to the point that it can no longer be refurbished by machining, the fusible layer 7 is melted to separate the facing 6 from the thermally conductive plate 3. A fresh sheet or layer of fusible material is subsequently sandwiched between the conductive plate surface 5 and a fresh facing 6. The fresh fusible material is thereupon melted to produce the layer 7 and bond the fresh facing 6 to the thermally conductive plate 3.

In the prior art, the thermally conductive plate contacts the strand being cast and is thus prone to cracking and/or wear. When the thermally conductive plate undergoes wear without cracking, it can be refurbished periodically by machining. However, the number of times that the thermally conductive plate can be machined is limited and the thermally conductive plate must thereafter be discarded. On the other hand, if cracking occurs, the thermally conductive plate must be discarded immediately. In either case, operating costs are significantly affected because the thermally conductive plate is expensive. Thus, the thermally conductive plate consists of a substantial mass of costly, high-grade copper or copper alloy. In addition, an expensive machining operation is required to form cooling channels in the thermally conductive plate.

The mold wall of FIG. 1 makes it possible to retain the thermally conductive plate 3 indefinitely by shielding it with the facing 6.

The mold wall of FIG. 2 differs from that of FIG. 1 in that the cooling channels 4 are located adjacent the conductive plate surface 5 which confronts the facing 6 rather than adjacent the back-up plate 2. Furthermore, the cooling channels 4 of FIG. 2 open to the surface 5. This arrangement enables the cooling efficiency for a continuously cast strand to be increased.

Figure 4:
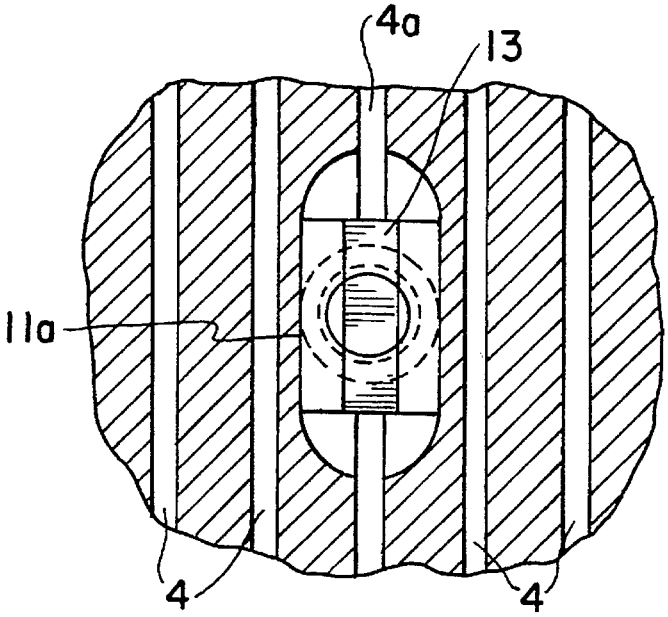
FIG. 4 is a sectional view as seen in the direction of the arrows IV—IV of FIG. 3.

In FIGS. 3 and 4, the externally and internally threaded inserts 11 of FIG. 1 are replaced by T-nuts **11*a* which are internally threaded only. Each T-nut 11*a* has a polygonal head. The larger portion 8 of each bolting hole 8,9 is here made up of a circular opening and a non-circular recess. The recess of a bolting hole 8,9 and the head of the respective T-nut 11*a* are provided with complementary surface portions which cooperate to hold the T-nut 11*a*** against rotation.

In contrast to the inserts 11, the T-nuts **11*a* do not require the machining of threads in the thermally conductive plate 3**. The elimination of threads in the thermally conductive plate not only allows manufacturing costs to be reduced but also makes it possible to form additional cooling channels in the thermally conductive plate at the locations of the bolts. Such additional cooling channels cannot be provided in the prior art where the thermally conductive plate is threaded in order to bolt the back-up plate and the thermally conductive plate to one another because the additional cooling channels would interrupt the continuity of the threads.

The additional cooling channels, of which one is shown at 4a in FIGS. 3 and 4, permit an increase in cooling efficiency to be achieved. To enable cooling fluid to flow past the T-nuts **11*a*, a clearance 8*a* is provided on either side of the respective T-nut head. These clearances 8*a* communicate with the adjacent additional cooling channel 4*a*. Furthermore, each T-nut head is provided with a groove 13 which traverses the T-nut head and opens to both clearances 8*a*. This allows cooling fluid to flow around the T-nuts 11*a* as indicated by the flow arrows 14**.

To make the mold wall of FIGS. 3 and 4, the T-nuts **11*a* are inserted in the larger hole portions 8 from that side of the thermally conductive plate 3 which faces away from the back-up plate 2. Following insertion of the T-nuts 11***a*, a sheet or layer of fusible material is sandwiched between the conductive plate surface 5 and the facing 6. The fusible material is then melted. Upon solidification of the fusible material to form the layer 7, the facing 6 is bonded to the thermally conductive plate 3. The back-up plate 2 and faced thermally conductive plane 3 are now placed adjacent one another in such a manner than each smaller hole portion 9 is in register with a larger hole portion 8. The bolts 12 are then inserted in the bolting holes 8,9 and threaded into the T-nuts 11*a* to draw the back-up plate 2 and the faced thermally conductive plate 3 into firm engagement with one another.

It is obvious that the facing 6 can be applied to the thermally conductive plane 3 after the back-up plate 2 and thermally conductive plane 3 have been bolted to each other.

In the mold wall of FIGS. 3 and 4, the cooling channels 4,4*a* are disposed adjacent the back-up plate 2 and open to the latter. The mold wall of FIG. 5 differs from that of FIGS. 3 and 4 in that the cooling channels 4,4*a* are adjacent, and open to, the conductive plate surface 5 which confronts the facing 6. This further enhances the cooling efficiency.

The mold wall of FIGS. 6 and 7 is again designed so that the thermally conductive plate 3 need not be threaded in order to bolt it to the back-up plate 2. Here, T-bolts 12*a* are used to hold the back-up plate 2 and the thermally conductive plate 3 together. The T-bolts 12*a* are oriented so that their heads are located in the larger portions 8 of the respective bolting holes 8,9. The larger hole portions 8 are in the form of non-circular recesses, and the bolt heads and larger hole portions 8 have complementary surface portions which cooperate to fix the bolts 12*a* against rotation. The threaded ends of the bolts 12*a* are disposed externally of the back-up plate 2 at the side of the latter remote from the thermally conductive plate 3. Nuts 11*b* are screwed onto the threaded ends of the bolts 12*a*.

Figure 6:
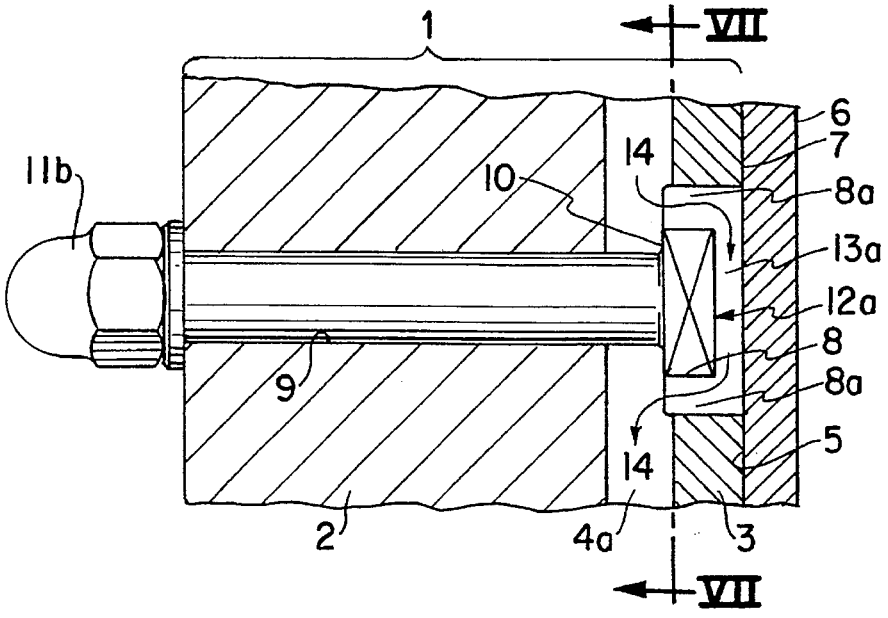
FIG. 6 is a view similar to that of FIG. 3 of one more embodiment of a mold wall in accordance with the invention.
Figure 7:
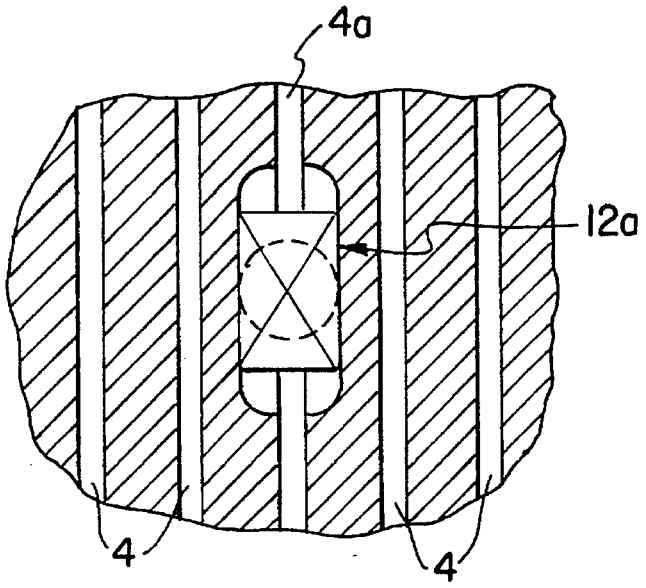
FIG. 7 is a sectional view as seen in the direction of the arrows VII—VII of FIG. 6.

The smaller hole portions 9 of FIGS. 6 and 7 extend into the thermally conductive plate 3. The larger hole portions 8 are situated adjacent, and open to, the surface 5 of the thermally conductive plate 3 which faces away from the back-up plate 2.

To enable cooling fluid to flow past the bolts 12*a*, the bolt heads are spaced from the surface 5 so as to define bypasses 13*a*. Moreover, a clearance 8*a* is provided on either side of each bolt head. The clearances 8*a* establish communication between the adjacent additional cooling channel 4*a* and the adjoining bypass 13*a*. Consequently, cooling fluid can flow around the bolts 12*a* as indicated by the flow arrows 14.

To make the mold wall of FIGS. 6 and 7, the shank of each bolt 12*a* is inserted in that part of a smaller hole portion 9 which is formed in the thermally conductive plate 3. Insertion takes place from the side of the thermally conductive plate 3 which faces away from the back-up plate 2. Subsequent to insertion of the bolts 12*a*, a sheet or layer of fusible material is sandwiched between the conductive plate surface 5 and the facing 6. The fusible material is then melted. Upon solidification of the fusible material to form the layer 7, the facing 6 is bonded to the thermally conductive plate 3. The back-up plate 2 and faced thermally conductive plate 3 are now aligned with one another in such a manner that the part of each smaller hole portion 9 in the back-up plate 2 receives the shank of a respective bolt 12*a*. The nuts 11*b* are thereupon screwed onto the threaded ends of the bolts 12*a* to draw the back-up plate 2 and the faced thermally conductive plate 3 into firm engagement with one another.

It is clear that the facing 6 can be applied to the thermally conductive plate 3 after the back-up plate 2 and thermally conductive plate 3 have been bolted to each other.

In the mold of FIGS. 6 and 7, the cooling channels 4,4*a* are adjacent to the back-up plate 2 and open thereto. The mold of FIG. 8 differs from that of FIGS. 6 and 7 in that the cooling channels 4,4*a* are situated adjacent, and open to, the conductive plate surface 5 which confronts the facing 6. Again, this enables the cooling efficiency to be increased.

The mold walls of FIGS. 6–8 allow the thickness of the thermally conductive plate to be reduced. Thus, due to stress considerations, the bolts of the prior art must be threaded into the thermally conductive plate to at least a certain minimum distance. This minimum distance determines the minimum thickness of the thermally conductive plate which, in the prior art, is about 1.6". By reversing the bolts as in FIGS. 6–8 so that the threaded ends of the bolts do not extend into the thermally conductive plate, the amount of thread required for load-bearing no longer poses a restriction on the minimum thickness of the thermally conductive plate.

Figure 9:
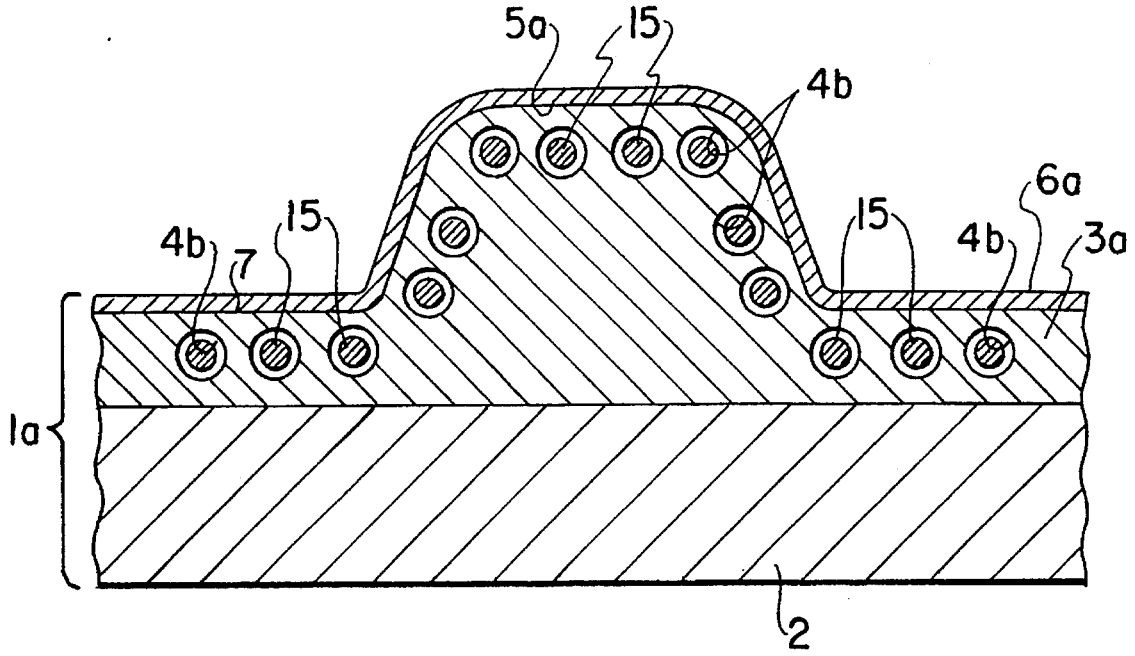
FIG. 9 is a view similar to that of FIG. 1 of yet a further embodiment of a mold wall according to the invention.

The mold walls of FIGS. 1–8 are particularly well-suited for the casting of blooms and slabs. FIG. 9, in contrast, illustrates a mold wall for the casting of beam blanks.

In FIG. 9, the reference numeral la identifies a carrier which differs from the carrier 1 in that the thermally conductive plate 3 is replaced by a thermally conductive, contoured block 3*a* having a shape which conforms to that of a beam blank. The cooling channels 4,4*a* of FIGS. 1–8, which have rectangular cross sections, are replaced by cooling channels 4*b* of circular cross section. The cooling channels 4*b* accommodate conventional restrictor rods 15.

The mold wall of FIG. 9, which is designed to form a channel in a continuously cast beam blank, has a facing 6*a* with a contour matching that of the thermally conductive block 3*a*. The facing 6*a* can be produced by precision bending or explosion forming a flat sheet of suitable material, e.g., rolled high-quality copper, to the shape of the thermally conductive block 3*a*.

In FIG. 9, the bolting holes 8,9 and bolts 12,12*a* have been omitted for clarity. However, the back-up plate 2 and thermally conductive block 3*a* of FIG. 9 are, in fact, bolted to one another in an appropriate manner which may be conventional.

Figure 10:
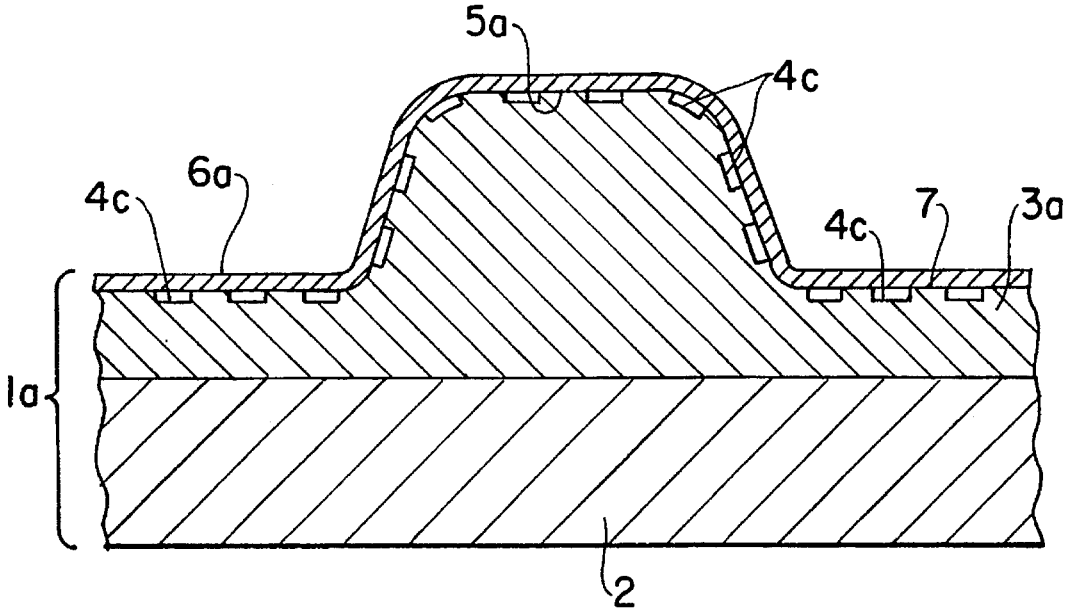
FIG. 10 is a view similar to that of FIG. 1 of an additional embodiment of a mold wall in accordance with the invention.

The mold wall of FIG. 10 differs from that of FIG. 9 in that the circular cooling channels 4*b* are replaced by cooling channels 4*c* of rectangular cross section. Furthermore, whereas the cooling channels 4*b* in the mold wall of FIG. 9 are spaced from the conductive block surface 5*a* which confronts the facing 6*a*, the cooling channels 4*c* of FIG. 10 are adjacent to the surface 5*a* and open to the latter. This allows better cooling efficiency to be obtained. The cooling channels 4*c* of FIG. 10 are also simpler to produce than the arrangement of circular channels 4*b* and restrictor rods 15 in FIG. 9.

In FIGS. 1–10, the carriers 1 and la include a back-up plate 2 and a thermally conductive element 3 or 3*a*. The cooling channels 4,4*a*,4*b*,4*c* are provided in the thermally conductive element 3 or 3*a*.

Figure 11:
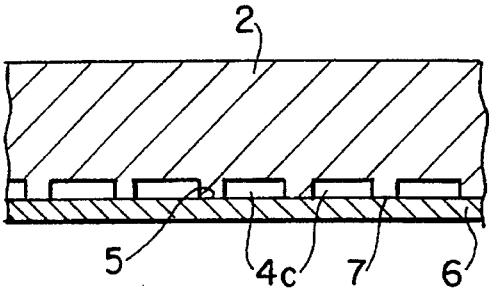
FIG. 11 is a view similar to that of FIG. 1 of still one more embodiment of a mold wall per the invention.

FIG. 11 shows a mold wall having a carrier which, in contrast to the composite carriers 1,1*a*, is made up of the carrier element or back-up plate 2 and does not include the thermally conductive element 3 or 3*a*. The back-up plate 2 of FIG. 11 has a major surface 5 and the thermally conductive facing 6 is bonded to the surface 5 by way of the fusible layer 7.

In the mold wall of FIG. 11, the cooling channels 4*c* are formed in the back-up plate 2. These cooling channels 4*c* open to the major surface 5 which confronts the facing 6.

Figure 12:
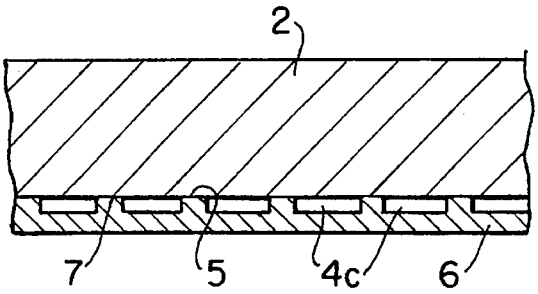

The mold wall of FIG. 12 differs from that of FIG. 11 in that the cooling channels 4*c* are provided in the facing 6. By forming the cooling channels 4c in the facing 6, the cooling efficiency is increased.

Similarly to the mold walls of FIGS. 1–8, the mold walls of FIGS. 11 and 12 are especially well-adapted for the casting of blooms and slabs.

It has been found that the walls of prior art slab molds distort about the bolts which hold the back-up plate and the thermally conductive plate together. The mold walls of FIGS. 11 and 12 make it possible to dispense with the bolts so that distortion may be reduced or eliminated.

Furthermore, as a consequence of the bolts which hold the back-up plate and thermally conductive plate of a prior art slab mold wall together, the cooling channels in such mold wall are relatively narrow and deep with dimensions of approximately ¼" by ¾". Due to the narrowness and depth of the cooling channels in the slab mold walls of the prior art, their cooling efficiency is relatively low. The mold walls of FIGS. 11 and 12 make it possible to increase the cooling efficiency since they permit the bolts to be eliminated thereby allowing the cooling channels to be wider and shallower than previously.

FIGS. 13 and 14 illustrate one manner of supplying cooling fluid to the cooling channels 4 of the mold walls of FIGS. 2, 5 and 8. A similar construction can be used for the mold wall of FIG. 10.

In FIGS. 13 and 14, a fluid supply duct 16 is provided in the back-up plate 2 of a mold wall and has an inlet end at the side of the back-up plate 2 which faces away from the thermally conductive plate 3. The supply duct 16 further has an outlet end which opens into a plenum chamber 17 formed in the back-up plate 2 adjacent to the thermally conductive plate 3. The plenum chamber 17 distributes the cooling fluid to the cooling channels 4 of the mold wall via distributing passages 18 each of which connects one end of a respective cooling channel 4 with the plenum chamber 17. An identical arrangement is provided at the other ends of the cooling channels 4 for discharge of the cooling fluid. The flow of cooling fluid from the supply duct 16 to the cooling channels 4 is indicated by the arrow 19. The plenum chamber 17 is sealed by an annular sealing element 20, such as an O-ring, located in an annular groove 21.

In the prior art, the cooling channels are situated at the interface between the back-up plate and the thermally conductive plate and open to the interface. Consequently, cooling fluid seeps into the interface so that the interface is wet. Since the bolts which hold the back-up plate and the thermally conductive plate together extend through the interface, it is necessary to seal each of these bolts in the area of the interface in order to protect them against corrosion.

By placing the cooling channels 4 and 4c of the mold walls of FIGS. 2, 5, 8 and 10 adjacent to the facing 6 or 6a, seepage of cooling fluid into the interface between the back-up plate 2 and the thermally conductive plate 3 can be avoided. This makes it possible to greatly simplify sealing because only the two plenum chambers 17 need be sealed instead of a large number of bolts bolts 12 and 12a.

Since the facing 6 or 6a in a mold according to the invention is connected to the carrier 1, 1a or 2 by fusible materials it is not necessary for the facing 6 or 6a to be capable of receiving mechanical fastening elements. This allows the facing 6 or 6a to be relatively thin.

The fusible material which forms the fusible layer can be melted in any convenient manner. For example, a sandwich of carrier elements fusible material and facing can be placed in an oven or furnace in order to melt the fusible material, The melting point of the fusible material should be lower than the melting points of the components which are heated when the fusible material is melted. In the embodiments of FIGS. 1–10, the melting point of the fusible material should be lower than the melting points of at least the facing 6 or 6a and the carrier element 3 or 3a to which the facing 6 or 6a is applied. The melting point of the fusible material in the embodiments of FIGS. 11 and 12 should be lower than the melting points of the facing 6 and the carrier element 2.

The fusible material should also melt at a temperature below that which would significantly affect the components heated during melting of the fusible material.

Various modifications can be made within the meaning and range of equivalence of the appended claims.

We claim:

1. A wall for a continuous casting mold, comprising a carrier having at least one carrier element; a thermally conductive facing on said one carrier element adapted to contact and cool a continuously cast strand travelling through the mold; and a fusible connecting layer joining said facing to said one carrier element, said connecting layer including solder and having a melting point lower than the melting points of said one carrier element and said facing.

2. The wall of claim 1, wherein said one carrier element comprises a plate.

3. The wall of claim 1, wherein said one carrier element has a surface directed towards said facing, said surface and said facing having sections which are substantially complementary to a channel of a beam blank.

4. The wall of claim 1, wherein said one carrier element comprises steel.

5. The wall of claim 1, wherein said one carrier element contains copper and said carrier includes an additional carrier element comprising steel, said one carrier element being juxtaposed with, and having a surface which faces away from, said additional carrier element, and said facing being adjacent to said surface.

6. The wall of claim 1, wherein said facing comprises a sheet.

7. The wall of claim 1, wherein said facing comprises copper.

8. The wall of claim 1, wherein said one carrier element is provided with cooling channels.

9. The wall of claim 8, wherein said one carrier element has a surface directed towards said facing, at least one of said cooling channels being open at said surface.

10. The wall of claim 1, wherein said facing is provided with cooling channels.

11. The wall of claim 1, wherein said carrier has a surface directed towards said facing, said carrier being provided with a hole which is open at said surface; and further comprising at least one fastening element in said hole.

12. The wall of claim 11, wherein said hole has a first portion of larger cross section which is open at said surface and a second portion of smaller cross section extending from said first portion away from said surface, at least part of said one fastening element being located in said first portion.

13. The wall of claim 12, wherein said one fastening element has a first part of larger cross section in said first portion and a second part of smaller cross section in said second portion.

14. The wall of claim 12, wherein said one fastening element has a threaded bore; and further comprising an additional fastening element which extends from said second portion into said bore and meshes with said one fastening element.

15. The wall of claim 12, wherein said one fastening element has a shank and a head on said shank, said head being located in said first portion and said shank extending into said second portion.

16. The wall of claim 15, wherein said carrier has an additional surface directed away from said facing and said second portion is open at said additional surface, said shank having an end which projects outwards of said additional surface; and further comprising stressing means for said one fastening element in engagement with said end.

17. The wall of claim 11, wherein said one carrier element is provided with a cooling channel which intersects said hole.

18. A wall for a continuous casting mold, comprising a carrier having at least one carrier element; a thermally conductive facing on said one carrier element adapted to contact and cool a continuously cast strand travelling through the mold, said carrier having a surface directed towards said facing, and said carrier being provided with a hole having a first portion which is open at said surface and a second portion extending from said first portion away from said surface; a fastening element having a shank and a head on said shank, said head being located in said first portion and said shank extending into said second portion; and a fusible connecting layer joining said facing to said one carrier element, said connecting layer having a melting point lower than the melting points of said one carrier element and said facing.

19. A method of making a mold, comprising the steps of sandwiching a fusible material between a carrier element and a thermally conductive facing for said carrier element, said material including solder and having a melting point lower than the melting points of said carrier element and said facing; and joining said facing to said carrier element, the joining step including melting said material to thereby form a connecting layer between said carrier element and said facing upon solidification of the molten material.

20. The method of claim 19, wherein said carrier element comprises a plate.

21. The method of claim 19, wherein said carrier element has a surface directed towards said facing, said surface and said facing having sections which are substantially complementary to a channel of a beam blank.

22. The method of claim 19, wherein said facing comprises a sheet.

23. The method of claim 19, wherein said carrier element comprises steel.

24. The method of claim 19, wherein said carrier element comprises copper.

25. The method of claim 19, wherein said facing comprises copper.

26. The method of claim 19, further comprising the steps of removing said facing from said carrier element by melting said connecting layer, sandwiching fresh fusible material between said carrier element and a fresh facing for said carrier element, and melting said fresh material to thereby form a fresh connecting layer between said carrier element and said fresh facing upon solidification of the molten fresh material.

27. The method of claim 19, wherein said carrier element has a surface which is directed towards said facing; and further comprising the step of inserting a fastening element into said carrier element via said surface prior to the sandwiching step.

28. A method of making a mold, comprising the steps of sandwiching a fusible material between a carrier element and a thermally conductive facing for said carrier element, said material having a melting point lower than the melting points of said carrier element and said facing; joining said facing to said carrier element, the joining step including melting said material to thereby form a connecting layer between said carrier element and said facing upon solidification of the molten material; and removing said facing from said carrier element by melting said connecting layer.

29. The method of claim 28, further comprising the steps of sandwiching fresh fusible material between said carrier element and a fresh facing for said carrier element following the removing step; and melting said fresh material to thereby form a fresh connecting layer between said carrier element and said fresh facing upon solidification of the molten fresh material.

30. A method of making a mold, comprising the steps of sandwiching a fusible material between a carrier element and a thermally conductive facing for said carrier element, said material having a melting point lower than the melting points of said carrier element and said facing, and said carrier element having a surface which is directed towards said facing; inserting a fastening element into said carrier element via said surface prior to the sandwiching step; and joining said facing to said carrier element, the joining step including melting said material to thereby form a connecting layer between said carrier element and said facing upon solidification of the molten material.

* * * * *